United States Patent [19]

Marks

[11] Patent Number: 4,974,381

[45] Date of Patent: Dec. 4, 1990

[54] TIE ANCHOR AND METHOD FOR MANUFACTURING INSULATED CONCRETE SANDWICH PANELS

[76] Inventor: Karl R. Marks, 119 D Rd. NE Star Rt., Moses Lake, Wash. 98837

[21] Appl. No.: 385,355

[22] Filed: Jul. 27, 1989

[51] Int. Cl.[5] ..... E04C 1/00

[52] U.S. Cl. ..... 52/309.12; 52/405; 52/410; 52/677

[58] Field of Search ..... 52/309.12, 405, 612, 52/677, 687, 410, 712, 715, 684, 685, 686, 689

[56] References Cited

U.S. PATENT DOCUMENTS

| | | | |
|---|---|---|---|
| 1,637,742 | 8/1927 | Edge et al. | 52/685 |
| 1,835,806 | 12/1931 | Olmstead et al. | 52/687 X |
| 1,911,957 | 5/1933 | Kassmir | 52/687 |
| 2,261,510 | 11/1941 | Atcheson | 52/712 |
| 3,217,457 | 11/1965 | Narr | 52/714 |
| 3,378,981 | 4/1968 | Horne | 52/712 |
| 3,757,482 | 9/1973 | Haeussler | 52/405 |
| 3,943,676 | 3/1976 | Ickes | 52/309.12 |
| 3,996,713 | 12/1976 | Haeussler | 52/410 |
| 4,117,639 | 10/1978 | Steenson et al. | 52/410 X |
| 4,283,896 | 7/1981 | Fricker | 52/410 |
| 4,541,211 | 9/1985 | Garrett | 52/410 |
| 4,624,089 | 11/1986 | Dunker | 52/410 |

*Primary Examiner*—Henry E. Raduazo
*Assistant Examiner*—Linda J. Hoffert
*Attorney, Agent, or Firm*—Dowrey, Cross & Cole

[57] ABSTRACT

A tie anchor for sandwich panels of reinforced concrete is formed as a flat strap. The reinforced concrete sandwich panel is formed by placing a plurality of tie members vertically in the bottom of a horizontal form with reinforcing rods extending through holes in the ends of the ties adjacent to cross-feet. A network or grid of reinforcing steel is supported from a chair provided by the ties and cross-feet and the concrete for the first layer of the panel is poured about the ties, cross-feet and reinforcing steel grid. A layer of rigid insulation material is placed on top of the first layer of wet concrete about the projecting tie members immediately after pouring the first layer of concrete and a second grid of reinforcing steel rods is supported from the holes in the projecting upper ends of the tie members. The second layer of concrete may be immediately poured about the upper end of the tie members and reinforcing steel. The insulation material may occupy the entire area between the two concrete layers of the panel except for an 8-10 inch solid concrete section along the bottom edge of the panel connecting the layers.

15 Claims, 4 Drawing Sheets

FIG. 5
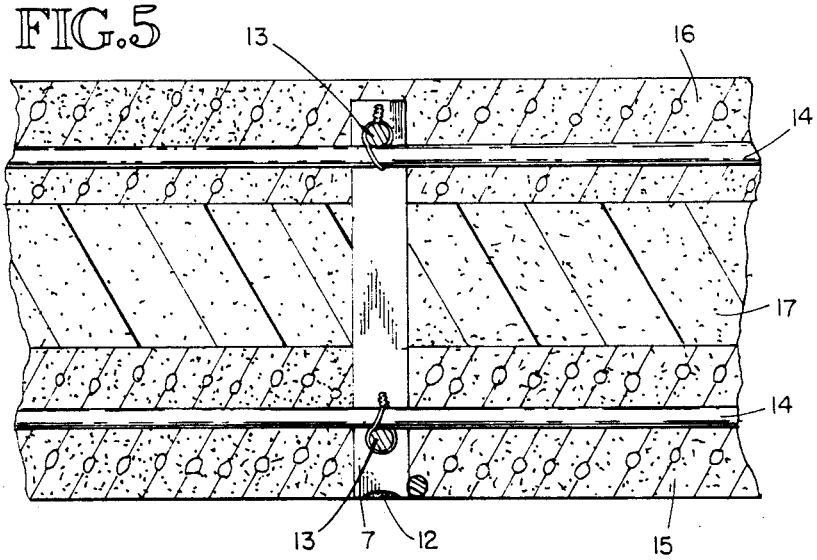
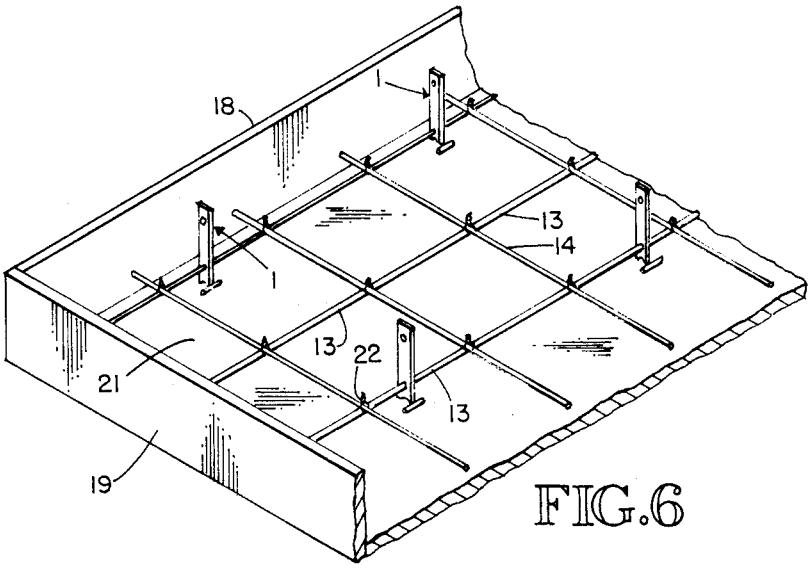
FIG. 6

TIE ANCHOR AND METHOD FOR MANUFACTURING INSULATED CONCRETE SANDWICH PANELS

BACKGROUND OF THE INVENTION

1. Field of the Invention

The present invention relates to a tie anchor or link for structurally connecting two spaced concrete slabs or layers of a tilt-up wall panel which has a layer of rigid insulation sandwiched therebetween. The invention further relates to a novel panel structure and the method or system for assembling such sandwich panels wherein the tie anchor also acts as a support "chair" and spacer for the reinforcing steel grids during formation of the concrete slabs.

2. Description of the Prior Art

Steel reinforced concrete sandwich panels having an intermediate layer of rigid insulation are generally known in the prior art. It is also known in the prior art to provide structural tying members of various designs which extend through the intermediate insulation layer and are anchored in the spaced concrete slabs. Examples of this type of panel construction are found in the U.S. Patent to Fricker U.S. Pat. No. 4,283,896 and the two U.S. Patents to Haeussler U.S. Pat. Nos. 3,757,482 and 3,996,713. These patents also illustrate the common expedient of passing the concrete slab reinforcing bars or rods through openings in the tie members to structurally connect the spaced concrete slabs. Although not specifically disclosed in these three patents, one method used in forming the concrete slabs is to pour them in a vertical orientation between vertical mold members or forms with the steel reinforcing grid assembly serving to support the tie members during formation of the sandwich panel. The two Haeussler patents illustrate a tubular tie anchor having extremely rigid structural characteristics whereby only one such tie member may usually be used for each composite panel or slab. This is discussed in Haeussler U.S. Pat. No. 3,996,713, the problem being one of accommodating a limited relative mobility of the concrete slabs to accommodate thermal dimensional changes and the like.

The U.S. Patent to Garrett U.S. Pat. No. 4,541,211 illustrates a second type of tie anchor for concrete sandwich panels wherein a metal strap extends completely through the two concrete slabs and the intermediate rigid insulation layer. The Garrett ties additionally connect the vertical form panels so as to maintain them at a predetermined distance during the pouring operation. The strap ties serve to support the reinforcing rods which pass through holes in the body of the ties.

When it is desired to fabricate sandwich panels utilizing horizontal forms, one method has been to support the grids of reinforcing rods for the spaced concrete slabs by such means as holes in the forms as illustrated by U.S. Pat. No. 4,117,639 to Steenson et al. Another common practice is that of initially supporting the reinforcing grid or mesh of metal wires or bars on suitable spacer elements placed in the bottom of the form. U.S. Pat. No. 4,624,089 to Dunker discloses this method of construction and U.S. Pat. No. 3,378,981 to Horne illustrates a typical reinforcing rod chair or support for spacing the reinforcing members for horizontal pouring. In the Dunker patent, the tie anchors extend through the intermediate rigid insulation layer and are embedded in the spaced concrete slabs with the anchors being supported by the reinforcing grid during the pouring of the slabs.

Tie anchors have also been devised in the prior art for mechanically connecting double-wall masonry panels wherein one or both of the panels of the slab comprises bricks or masonry blocks. Examples of this type of construction are found in the Atecheson U.S. Pat. No. 2,261,510 and the Narr U.S. Pat. No. 3,217,457. In these instances, the tie strap must be imbedded in the mortar as the blocks or bricks are laid up in a conventional manner. In the Narr patent, the tie straps are supported by the spaced bricks until the mortar is set about the end of the strap and the concrete slab is cast in a form around the upper ends of the tie straps through which reinforcing rods have been placed. The form for the concrete slab must then be removed before the panel is erected. As may be appreciated this method of constructing brick or block double-wall structures is limited to relatively small size panels.

The construction of relatively large structures such as warehouses, cold storage structures and the like has become extremely competitive with reinforced concrete insulated sandwich walls being one of the common methods of building the structures. These sandwich walls are commonly fabricated in horizontal forms on the ground, either at the building site or at a fabricating yard. The assembled panels are then moved into place and erected at the final building wall position. The problems associated with formation of sandwich panel walls involve not only the positioning of tie anchors with sufficient tensile strength to support the spaced concrete slabs during moving and raising but also considerations of heat transfer from one concrete slab to the other by the tie anchors themselves. This latter consideration becomes of primary importance in the construction of cold storage facilities for instance. Another problem is in devising a method for placing the reinforcing steel grid accurately in the body of the concrete slabs in the successive formation of the two slabs separated by the rigid insulation. In larger building walls which may be as much as 60 feet in height the rebar or reinforcing steel grid for both concrete layers must be tied and held in place in a horizontal plane at the proper distance from the bottom of the form. The grids may weigh several tons depending on the size of the wall being formed. In addition, it is necessary to vibrate the wet concrete during or after pouring for proper settling. This is true of both concrete layers, of course, and having to pick up a collapsed reinforcing grid which has lost its support during the pour or vibrating operation is extremely costly in terms of the amount of time and labor it takes to relocate the grid. Because of the competition in forming the insulated panel walls, time and labor saving have become of paramount concern.

SUMMARY OF THE INVENTION

The tie anchor of the present invention is especially constructed to facilitate the horizontal pouring of the successive concrete layers with a layer of rigid insulation therebetween. A plurality of tie anchors are placed upright in the bottom of a form and act as "chairs" or supports and spacers for a grid of reinforcing steel rods in preparation for the horizontal pouring of each of the successive concrete layers. According to the present method and system for assembling the sandwich panel, a first horizontal reinforced concrete layer, an intermediate layer of rigid insulation material and a second reinforced concrete layer may be successively laid down in a horizontal form with no time loss between the formation of the successive layers of the sandwich panel.

The tie anchor extends through the intermediate layer of rigid insulation, is connected to the reinforcing steel of both slabs and imbedded in the concrete of both slabs of the panel. The tie anchor may be made from any material which has sufficient tensile strength to tie the concrete slabs together during the maximum stress condition incurred during the raising of the finished panel from the horizontal position to the vertical. The maximum stress is actually experienced between 0 and approximately 50 degrees of angle. After casting, the walls are normally raised by means of a crane with lifting and brace inserts being cast into the body of the slabs in a conventional manner during the pour. A typical wall panel will be in rectangular form measuring about 20 feet by 24 feet and utilizing approximately 25 tie anchors spaced strategically over the panel dimensions. A 9¼ inch thick panel suitable for such structures as cold storage buildings for instance will utilize a 4 inch concrete inside slab, 2 inches of rigid insulation board such as styrofoam or any other suitable commercially available insulating board and a 3¼ inch outside concrete slab.

An important feature of the tie anchor of the present invention is the utilization of a cross-foot rigidly connected to one end of one side edge of the tie anchor strap extending at right angles to the flat faces of the strap. The system for rapidly, efficiently and therefore economically assembling the sandwich panel utilizes the multiple tie anchors as "support chairs", first for the reinforcing steel of the bottom concrete slab and then for the reinforcing steel grid of the second horizontal concrete slab. The construction of a panel is begun by assembling a horizontal form of suitable dimensions for the finished panel and placing reinforcing steel on the bottom of the form. The links are then located on the reinforcing rods intended to be the vertical steel with the rods being passed through holes or apertures in the ends of the anchors adjacent the rigid cross-feet. With the links in the upright or vertical position and the reinforcing steel properly tied, the links perform the function of supporting the entire lower grid of steel in the proper position for reception of the concrete. At this point the lifting and brace inserts may be properly located in a well known manner followed by pouring of the concrete for the bottom slab. The slab is then vibrated and floated in a conventional manner. This of course requires workmen to move about and on the reinforcing steel. Just as soon as the first slab is properly prepared and with the concrete still wet, a layer of rigid polystyrene insulation material is placed directly on the new concrete with the upper ends of the links or tie anchors extending upwardly through the layer of insulation. A second grid of reinforcing steel is installed, again utilizing the holes or apertures in the opposite ends of the tie anchors to support the grid. The next layer of concrete is immediately poured directly on the rigid insulation about the steel grid and the upper ends of the anchors and vibrated. The desired surface treatment such as a broom or a trowel finish may then be accomplished. As soon as the concrete has reached the desired strength the panels may be raised to a vertical position with a crane and secured in place.

The utilization of the cross-foot on the tie anchor and utilizing the tie anchor as the support "chair" for the reinforcing steel ensures the rapid, accurate and stable placing of the steel grids in a manner far superior to any system known to the prior art. The end of the strap which rests on the bottom of the form may be cut away in order to minimize the exposed area which appears in the outer face of the bottom slab. The cross-bar or foot may be made of cylindrical stock to further minimize the surface exposure. The tie anchors may be constructed from strap iron of sufficient cross-section and tensile strength or may be made from high tensile strength plastics presently available, depending on the dimension of the panel. Metal tie anchors may also be dipped or coated with a non metallic plastic substance in order to minimize heat transfer from one panel slab to the other.

BRIEF DESCRIPTION OF THE DRAWINGS

FIG. 5 is a cross sectional view taken along lines 5—5 of FIG. 4, also illustrating the position in which the panel is assembled in a horizon plane; and FIGS. 6–9 illustrate the successive steps in the formation of a concrete sandwich panel according to the present invention.

DETAILED DESCRIPTION OF THE INVENTION

Figure 1:
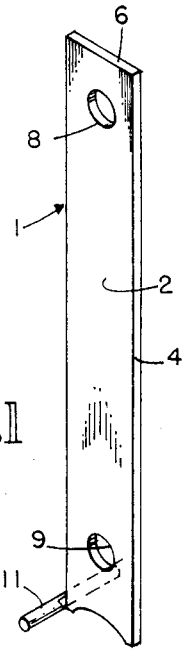
FIG. 1 is an isometric view of the tie anchor.
Figure 2:
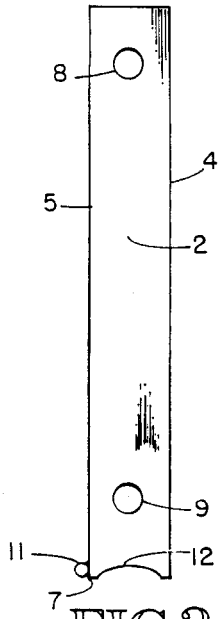
FIG. 2 is a side elevation of the tie anchor.
Figure 3:
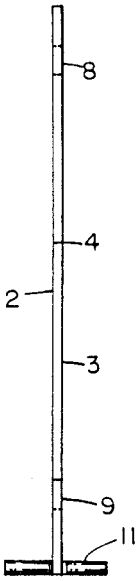
FIG. 3 is an end elevation of the tie anchor.

Referring to FIGS. 1–3, the tie anchor 1 includes a flat strap body having the two wide side faces 2 and 3, the longitudinal narrow side edges 4 and 5, the top end edge 6 and the bottom end edge 7. In practice, the tie anchor has been fabricated from strap steel typically of 3/16th inch stock, having a width of 1½ inches and a total length of 10¾ inches. It will be appreciated, however, that these dimensions may vary depending upon the size and weight of the particular wall being fabricated. Alternatively, the tie anchor may be made from a high tensile strength plastic with the appropriate strength characteristics for the wall design and accordingly dimensioned. A ⅝ths inch hole 8 is located adjacent the upper end edge 6 and a similar ⅝ths inch hole 9 is located adjacent the bottom end edge 7 of the strap. The sizing of the holes 8 and 9 will, of course, be determined by the diameter of the particular rebar steel being utilized. The ⅝ths inch hole is described as being one of the more common rebar sizing. A cross-bar or foot 11 is welded to the longitudinal edge surface 5 at the bottom end of the anchor. The length of the cross-foot may be varied, of course, but should be in the neighborhood of several inches in length. In the case of an iron or steel strap member, the cross bar 11 may be welded to the body of the strap as illustrated. The end edge 7 is also cut away as at 12 in any concave configuration so as to minimize the end edge surface of the strap which will be exposed in the finished concrete panel. The initial position of the tie anchor is that shown in FIGS. 1–3 and 5 with the bottom edge surface 7 resting on the bottom of the panel form and the bottom longitudinal peripheral edge of the cross-bar 11 also seated on the form bottom. In this position the anchor is quite stable and, when a plurality of such anchors are placed as spaced intervals on the vertical steel of the grid for the bottom slab, the entire grid is stabilized. The suspended grid is capable of withstanding mechanical impact experienced either by workmen moving about the grid or the vibrating action once the concrete is poured. This grid with the vertical links and cross-feet becomes a self-supported network in the bottom of the form accurately located the proper distance from the intended outside slab face.

Figure 4:
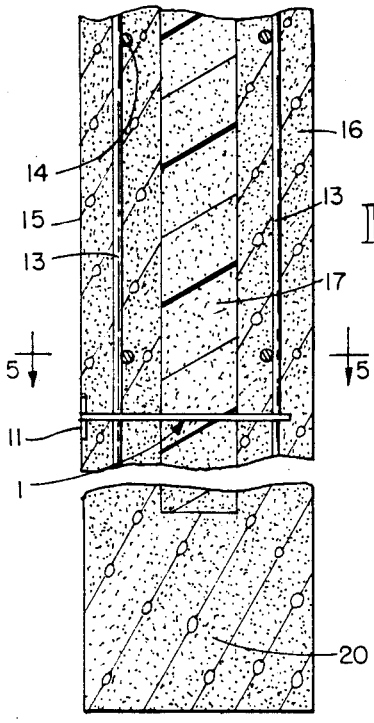
FIG. 4 is a vertical section taken through a finished panel showing the placement of a tie anchor and reinforcing steel grids.

FIGS. 4 and 5 illustrate the composition of the sandwich panel in its finished form. The vertical steel reinforcing rods 13 of both concrete layers extend through the opposite ends of the link 1 by means of the holes 8 and 9 with the horizontal steel rods 14 running at right angles thereto and also embedded in the concrete layers 15 and 16. The intermediate layer of rigid insulation 17 surrounds the links and fills the space between the two concrete layers except for the concrete connecting portion 20 located at the bottom edge of the panel as indicated in FIG. 4. The two concrete layers illustrated in the present embodiment are thus connected at their bottom ends along their entire length by a solid concrete portion. The connecting links or anchors 1 provide the remaining structural tie between the upright concrete layers in their upright position.

FIGS. 6–9 illustrate the various steps involved in the fabrication of a typical sandwich panel utilizing the tie anchor and cross-foot method of assembling the panel. As illustrated in FIG. 6, the vertical panel form walls 18 and 19 are placed in a horizontal plane and will be suitably mounted on a form bottom 21 of conventional design. The horizontal and vertical steel rods 13 and 14 are initially laid in the bottom of the form and tie anchor and cross-foot members 1 are then located on the vertical steel rods 13 which serves to support the grid of reinforcing rods a proper distance from the bottom wall of the form. As indicated in FIG. 6, the rods 13 and 14 may be tied as at 22 in a conventional manner to aid in rigidifying the grid prior to pouring. Once the reinforcing rods and tie anchors are in place, the first layer of concrete may be poured and vibrated ready for the application of the layer of rigid insulation.

Figure 7:
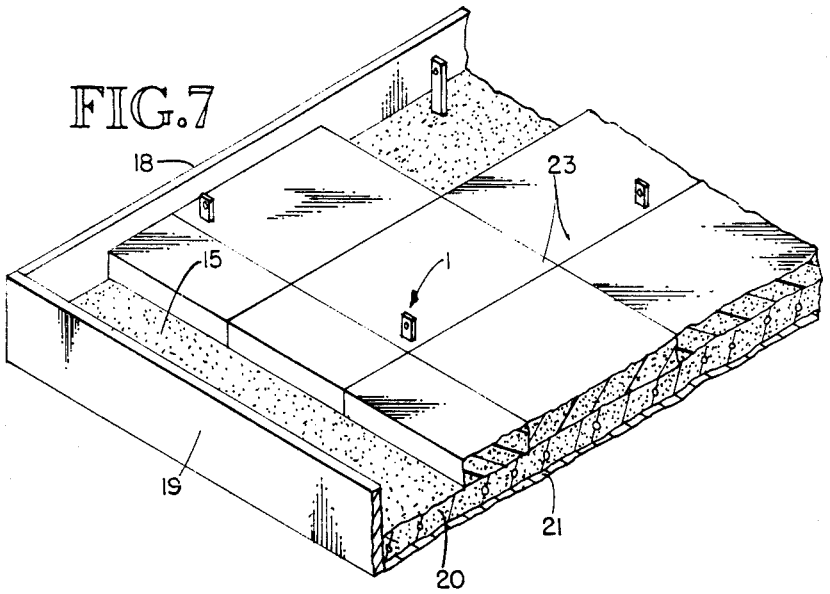

FIG. 7 illustrates the placement of the rigid insulation layer 17, usually in the form slabs or blocks of insulation board 23, which is laid down immediately on the wet concrete of the bottom slab 15. The rigid insulation may be punched or perforated for the purpose of passing over the ends of the tie anchors 1. The rigid insulation boards 23 are capable of supporting the weight of the workmen during the placement of the reinforcing grid for the second concrete slab. As seen clearly in FIG. 7, the bottom edge portion of the slab 15 is left exposed or uncovered by the layer of insulation blocks 23. The uncovered portion 20 of the slab will normally be 8–10 inches wide in a conventional 20×25 foot panel such that the upper and lower concrete slabs are thus connected along the bottom edge of the panel. The layer of rigid insulation is otherwise exposed on the remaining three sides of the rectangular panel.

Figure 8:
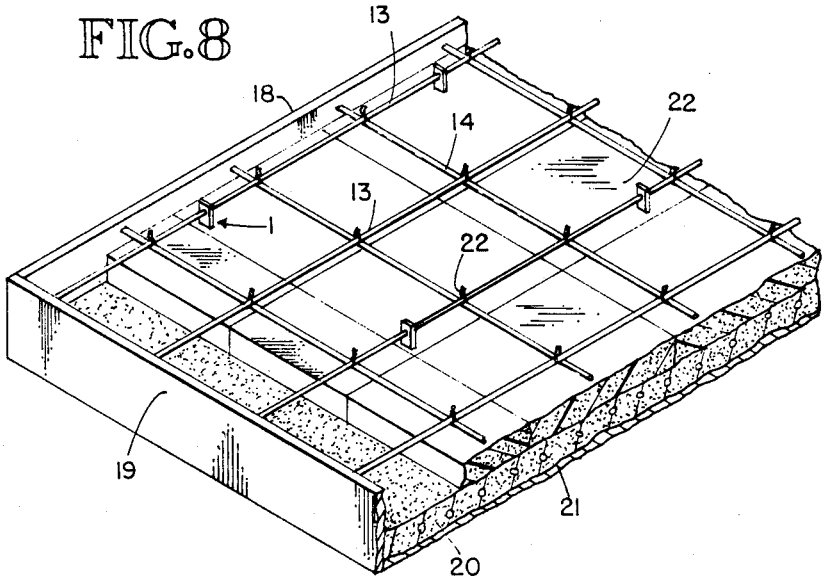
Figure 9:
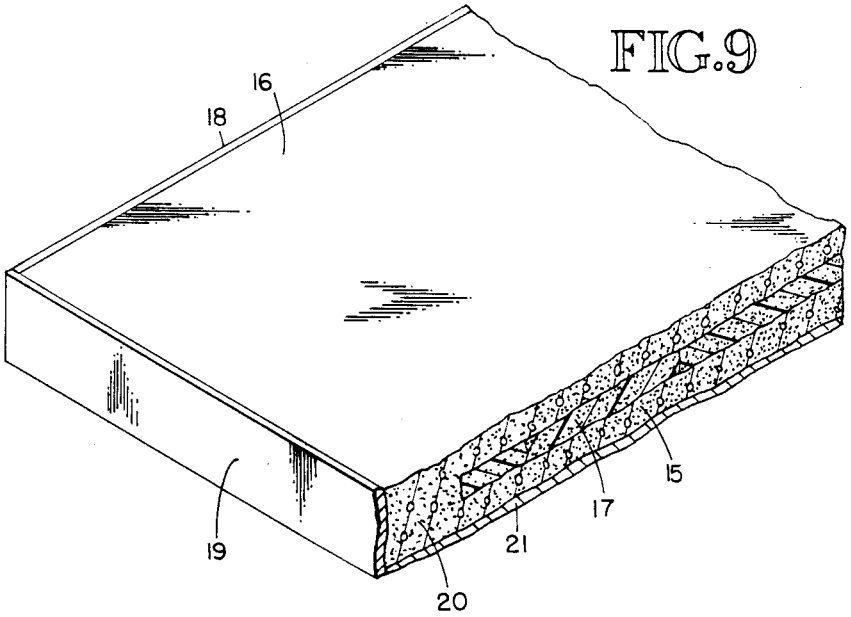

Once the layer of rigid insulation 23 is in place, the steel grid for the top slab 16 may be installed by passing the vertical steel 13 through the holes in the upper ends of the anchors and tying the horizontal rods 14 in a conventional manner as shown FIG. 8. As previously mentioned, workmen may walk directly on the rigid insulation layer 17 for placing the grid. Just as soon as the upper grid of reinforcing rods is in place, the top slab 16 may be poured on top of the rigid insulation about the upper grid. The monolithic connection 20 along the bottom edge of the panel will be formed with the wet slab 15 as illustrated in FIG. 9. The panel is completed by again vibrating and either troweling, brooming or providing any type of aesthetic surface desired to the outside face of the slab 16. Once the concrete has hardened to the desired strength, the panel may be raised by crane and located in place to form the building wall.

While the present invention has been described with relation to a single embodiment of the tie anchor and the assembly method of one embodiment of the sandwich wall, it will be understood that modifications may be made to the invention without departing from the spirit and scope of the invention defined in the following claims.

I claim:

1. A wall tie for use in the fabrication of wall structures comprising;

an elongated body part of substantially constant rectangular section over its length and having two broader and two narrower lengthwise extending sides, a first aperture passing through the body part near one end thereof and a second aperture passing through the body part near the opposite end thereof, and a rod secured to one of the said narrower sides of the body part at one end thereof and extending transversely to the body part, the entire length of said body part having substantially planar surfaces with said rod being the sole projection from any body part surface.

2. A tie anchor for use in the fabrication of insulated reinforced concrete panels having at least two concrete layers separated by a layer of rigid insulation material, said panels being fabricated by sequentially pouring said concrete layers in a horizontal plane in a form having a horizontally disposed bottom wall, said tie anchor comprising;

a tie body comprising a generally flat, elongated rigid tension member having opposed face surfaces, an aperture adjacent each terminal end of said tie body, and chair support means connected to one end of said tie body and extending transversely to the plane of said tie body in each direction beyond said opposed face surfaces, whereby said tie body may be placed upright on the bottom wall of a panel form supported by said chair support means and reinforcing rods supported by said apertures for sequentially pouring said concrete layers in a horizontal plane.

3. A tie anchor for use in the fabrication of insulated reinforced concrete panels having at least two concrete layers separated by a layer of rigid insulation material, said panels being fabricated by sequentially pouring said concrete layers in a horizontal plane in a form having a horizontally disposed bottom wall, said tie anchor comprising;

an elongated tie body having top and bottom ends and a bottom support surface, said body being of sufficient length so as to have said bottom end support surface located in the outside face of one said concrete layers and said top end embedded in the body of the other concrete layer, at least one aperture in said tie body adjacent each said top and bottom ends for the passage of concrete reinforcing rods, said tie body comprising a tension link extending through said insulation layer and structurally connecting said concrete layers, a cross member connected to the bottom end of said body and having a support surface thereon extending transversely to said tie body, said cross member support surface being of sufficient extent so as to cooperate with said bottom end support surface, when placed on the bottom wall of said form, to support the tie body in a vertical position and to maintain concrete reinforcing rods, extending through said apertures, in a horizontal plane at a predetermined distance from the bottom wall of said form for pouring said concrete layers.

4. The tie anchor according to claim 3 wherein;

said cross member comprises a cylindrical rod and said support surface comprises a longitudinally extending narrow linear edge on the surface of said rod flush with bottom end support surface of said tie body, whereby the surface exposure of said cross member support surface in the outside surface of said one concrete layer is minimized.

5. The tie anchor according to claim 4 wherein;

said bottom end support surface includes a concave portion to minimize its surface exposure on the outside surface of said one concrete layer.

6. The tie anchor according to claim 3 wherein said tie body and said cross member are covered with a non metallic plastic coating.

7. An insulated reinforced concrete building panel comprising;

an inner layer of concrete, an outer layer of concrete, each said layer of concrete having reinforcing strands embedded therein, a layer of rigid insulation material interposed between said layers of concrete, a plurality of spaced elongated connector ties interconnecting the concrete layers of said panel, said connector ties having one end located in the face of said inner layer of concrete and extending through said insulation layer and having their opposite ends embedded in said outer layer of concrete, each of said connector ties having certain ones of said reinforcing strands of each concrete layer passing through the body thereof, and support members connected to one end of each said connector ties located in the exposed face of said inner layer of concrete, said layers of concrete being successively poured in a horizontal form with the support members and associated connector tie ends seated on the form bottom to support the connector ties in an upright position and the associated reinforcing strands in a horizontal plane spaced a predetermined distance from said form bottom during pouring, said rigid insulation layer being placed on said inner layer of concrete about said connector ties and said outer layer of concrete being poured directly on top of said layer of rigid insulation prior to hardening of the inner concrete layer.

8. A method for fabricating a sandwich panel comprising;

supporting first reinforcing strands on spaced upright tie anchors seated on the bottom of a horizontal panel form, said tie anchors including cross members connected to the bottom ends thereof forming support chairs for said strands, pouring a first layer of concrete about said first strands with the exposed ends of said tie anchors extending above said first layer, placing a layer of rigid insulation on the first layer, supporting second reinforcing strands from the exposed ends of said tie anchors spaced from said insulation layer, and then pouring a second layer of concrete about said second strands on top of said insulation layer.

9. The method of claim 8 wherein said layer of insulation is placed on said first layer prior to hardening thereof.

10. The method of claim 9 wherein said second layer is poured on top of said insulation prior to hardening of said first layer.

11. The method of claim 10 wherein the insulation layer is omitted from a portion of the surface of said first layer, whereby said second layer is poured thereon to form a monolithic section of said panel.

12. A method for fabricating an insulated reinforced concrete sandwich panel comprising;

supporting a first grid of reinforcing strands in a generally horizontal plane on the bottom of a concrete panel form, said first grid being spaced from the bottom of the panel form and supported by spaced upright tie anchors having horizontal cross support members connected to the bottom ends thereof forming grid chairs seated on the bottom of the panel form with certain of said reinforcing strands engaged by said tie anchors, pouring a first layer of concrete about said first grid with the exposed ends of said anchors extending above said first layer, placing a layer of rigid insulation on the surface of said first layer about the exposed upper ends of said tie anchors prior to hardening of the first layer, supporting a second grid of reinforcing strands in a generally horizontal plane above said rigid insulation layer said second grid being spaced from the rigid insulation layer and supported by said anchor with certain of the strands thereof engaged by said tie anchors; and then pouring a second layer of concrete about said second grid on top of said rigid insulation prior to hardening of said first layer.

13. A tie anchor for use in the fabrication of insulated reinforced concrete panels having at least two concrete layers separated by a layer of rigid insulation material, said panels being fabricated by sequentially pouring said concrete layers in a horizontal plane in a form having a horizontally disposed bottom wall, said tie anchor comprising;

a tie body comprising a generally flat, elongated rigid tension member having opposing face surfaces, an aperture adjacent each terminal end of said tie body extending therethrough between said opposing face surfaces, chair support means on one end of said tie body and extending transversely to the plane of said tie body in each direction beyond said opposed face surfaces, whereby said tie body may be placed upright on the bottom wall of a panel form supported by said chair support means and reinforcing rods supported by said apertures for sequentially pouring said concrete layers in a horizontal plane.

14. A tie anchor for use in the fabrication of wall structures comprising;

an elongated tie body comprising a generally flat elongated rigid member having opposing face surfaces, at least one aperture extending through said tie body between said face surfaces, chair support means on one end of said tie body and extending transversely to the plane of said tie body in both directions beyond said opposed face surfaces, whereby said tie body may be placed upright on the bottom wall of a panel form supported by said chair support means and reinforcing means supported by said at least one aperture.

15. A method for fabricating a sandwich panel comprising;

supporting first reinforcing strands on spaced upright tie anchors seated on the bottom of a horizontal panel form, each said tie anchor comprising a generally flat elongated rigid member having opposing face surfaces and chair support means on one end thereof extending transversely to the plane of said member in both directions beyond said opposed face surfaces, pouring a first layer of concrete about said first strands with the exposed ends of said anchors extending above said first layer, placing a layer of rigid insulation on the first layer, supporting second reinforcing strands from the exposed ends of said tie anchors spaced from said insulation layer, and then pouring a second layer of concrete about said second strands on top of said insulation layer.

* * * * *